US009196222B2

(12) United States Patent
Moon et al.

(10) Patent No.: US 9,196,222 B2
(45) Date of Patent: Nov. 24, 2015

(54) METHOD OF DISPLAYING AN IMAGE, DISPLAY APPARATUS PERFORMING THE SAME, METHOD AND APPARATUS OF CALCULATING A CORRECTION VALUE APPLIED TO THE SAME

(71) Applicant: SAMSUNG DISPLAY CO., LTD., Yongin, Gyeonggi-do (KR)

(72) Inventors: Hoi-Sik Moon, Asan-Si (KR); Min-Kyu Park, Hwaseong-Si (KR); Jee-Hoon Jeon, Hwaseong-Si (KR); Sung-Goon Jung, Suwon-Si (KR); Young-Suk Ha, Uiwang-Si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 176 days.

(21) Appl. No.: 13/922,879

(22) Filed: Jun. 20, 2013

(65) Prior Publication Data

US 2014/0198134 A1 Jul. 17, 2014

(30) Foreign Application Priority Data

Jan. 17, 2013 (KR) ..... 10-2013-0005258

(51) Int. Cl.
*G09G 3/20* (2006.01)
*G09G 5/10* (2006.01)

(52) U.S. Cl.
CPC ... *G09G 5/10* (2013.01); *G09G 3/20* (2013.01)

(58) Field of Classification Search
CPC ..... G09G 3/20; G09G 5/10; G09G 3/36; G06K 9/00
USPC ..... 345/55, 690; 382/162
See application file for complete search history.

(56) References Cited

U.S. PATENT DOCUMENTS

| | | | | |
|---|---|---|---|---|
| 2003/0016189 | A1* | 1/2003 | Abe et al. | 345/55 |
| 2005/0093798 | A1 | 5/2005 | Kamada et al. | |
| 2009/0153592 | A1* | 6/2009 | Choi et al. | 345/690 |
| 2009/0169098 | A1* | 7/2009 | Chong et al. | 382/162 |
| 2009/0256865 | A1* | 10/2009 | Jun et al. | 345/690 |
| 2011/0025728 | A1* | 2/2011 | Baba et al. | 345/690 |

FOREIGN PATENT DOCUMENTS

| | | |
|---|---|---|
| JP | 2006-153914 | 6/2006 |
| KR | 10-2008-0028225 | 3/2008 |

OTHER PUBLICATIONS

English Abstract for Publication No. 2006-153914.
English Abstract for Publication No. 10-2008-0028225.

* cited by examiner

*Primary Examiner* — Nicholas Lee
*Assistant Examiner* — Abdul-Samad A Adediran
(74) *Attorney, Agent, or Firm* — F. Chau & Associates, LLC

(57) ABSTRACT

A method of displaying an image on a display panel having a plurality of pixels arranged as rows and columns includes calculating a row correction value corresponding to a pixel position of a received data based on an average luminance of pixels in a pixel row of a sample-grayscale image, calculating a column correction value corresponding to the pixel position of the received data based on an average luminance of pixels in a pixel column of the sample-grayscale image, generating correction data for the received data using a row correction value and a column correction value corresponding to a pixel position of the received data, and converting the correction data to a data voltage to provide a data line of the display panel with the data voltage.

16 Claims, 6 Drawing Sheets

METHOD OF DISPLAYING AN IMAGE, DISPLAY APPARATUS PERFORMING THE SAME, METHOD AND APPARATUS OF CALCULATING A CORRECTION VALUE APPLIED TO THE SAME

This application claims priority from and the benefit of Korean Patent Application No. 10-2013-0005258, filed on Jan. 17, 2013 in the Korean Intellectual Property Office, the contents of which are herein incorporated by reference for in their entirety.

BACKGROUND

1. Technical Field

Exemplary embodiments of the present disclosure are directed to a method of displaying an image, a display apparatus for performing the method of displaying the image, a method and an apparatus for calculating a correction value applied to the method and the display apparatus. More particularly, exemplary embodiments of the present disclosure are directed to a method of displaying an image capable of improving a stain of a display panel, a display apparatus for performing the method of displaying the image, and a method and an apparatus for calculating a correction value applied to the above-mentioned method and the display apparatus.

2. Discussion of the Related Art

In general, a liquid crystal ("LC") display panel includes a lower substrate, an upper substrate opposite to the lower substrate and an LC layer disposed between the lower substrate and the lower substrate. The lower substrate includes a pixel area defining a pixel and a peripheral area receiving a driving signal which is applied to the pixel.

A data line, a gate line and a pixel electrode are disposed in the pixel area. The data line extends in a first direction, the gate line extends in a second direction crossing the first direction and the pixel electrode is connected to the data line and the gate line. A first driving chip pad and a second driving chip pad are disposed in the peripheral area. The first driving chip pad receives a data signal and the second driving chip pad receives a gate signal.

After the LC layer is disposed between the lower substrate and the lower substrate, the LC panel is tested through a visual test process which tests electrical and optical operations of the LC panel. In general, the visual test process tests include testing various pattern stains by using a tester's eyes and removing the various pattern stains using a stain remover algorithm reflecting a tested result using the tester's eyes.

As described above, the various pattern stains are manually tested by the tester, which increases a test process period is increased and an identification differences of the testers. Thus, productivity may be decreased and compensation error may be increased.

BRIEF SUMMARY

Exemplary embodiments of the present disclosure provide a method of displaying an image for improving a stain of a display panel.

Exemplary embodiments of the present disclosure also provide a display apparatus for performing the method.

Exemplary embodiments of the present disclosure also provide a method of calculating a correction value applied to the method and the display apparatus.

Exemplary embodiments of the present disclosure also provide an apparatus of calculating a correction value applied to the method and the display apparatus.

According to an exemplary embodiment of the disclosure, there is provided a method of displaying an image on a display panel having a plurality of pixels arranged in rows and columns. The method includes calculating a row correction value corresponding to a pixel position of a received data based on an average luminance of pixels in a pixel row of a sample-grayscale image, calculating a column correction value corresponding to the pixel position of the received data based on an average luminance of pixels in a pixel column of the sample-grayscale image, generating correction data to compensate for the received data using a row correction value and a column correction value corresponding to a pixel position of the received data, and converting the correction data to a data voltage to provide a data line of the display panel with the data voltage.

In an exemplary embodiment, generating the correction data may include determining whether a grayscale of the received data corresponds to a sample-grayscale.

In an exemplary embodiment, when a grayscale of the received data is a sample-grayscale, the method may further include adding the row correction value and column correction value of the sample-grayscale corresponding to the pixel position of the received data to calculate a data correction value, and applying the data correction value to the received data to generate the correction data.

In an exemplary embodiment, when a grayscale of the received data is not a sample-grayscale, the method may further include adding a row correction value and a column correction value of a first sample-grayscale corresponding to the pixel position of the received data to calculate a first data correction value, the first sample-grayscale being a least grayscale value that is greater than the grayscale of the received data, adding a row correction value and a column correction value of a second sample-grayscale corresponding to the pixel position of the received data to calculate a second data correction value, the second sample-grayscale being a greatest grayscale value that is less than the grayscale of the received data, and applying the first data correction value and the second data correction value to the received data to generate the correction data.

In an exemplary embodiment, the data correction values may have more bits than the received data.

In an exemplary embodiment, the data correction value $f(m, n)$ may be defined by the following Equation: $f(m, n)=a\times X_m+b\times Y_n$, wherein $(m, n)$ is the pixel position, $X_m$ is the column correction value of the pixel position, $Y_n$ is the row correction value of the pixel position, and "a" and "b" are predetermined weights.

According to still another exemplary embodiment of the invention, there is provided a display apparatus. The display apparatus includes a display panel having a plurality of pixels arranged in rows and column, a storage part configured to store a row correction value and a column correction value corresponding to a sample-grayscale, the row correction value being calculated based on an average luminance of pixels in a pixel row of a sample-grayscale image, the column correction value being calculated based on an average luminance of pixels in a pixel column of the sample-grayscale image, a stain correction part configured to generate correction data for received data using a row correction value and a column correction value corresponding to a pixel position of the received data, and a data driving part configured to convert the correction data to a data voltage to provide a data line of the display panel with the data voltage.

In an exemplary embodiment, the stain correction part may include a correcting part configured to add the row and column correction values to calculate a data correction value and to apply the data correction value to the received data to generate the correction data, and an interpolating part configured to calculate the data correction value using linear interpolation.

In an exemplary embodiment, when the grayscale of the received data is a sample-grayscale, the correcting part may add the row correction value and the column correction value of the sample-grayscale corresponding to the pixel position of the received data to calculate a data correction value, and apply the data correction value to the received data to generate the correction data.

In an exemplary embodiment, when the grayscale of the received data is not a sample-grayscale, the correcting part may calculate a first data correction value and a second data correction value using row and column correction values of two sample-grayscales, and the interpolating part may calculate the data correction value corresponding to the grayscale of the received data using linear interpolation.

In an exemplary embodiment, the two sample-grayscales may include a first sample-grayscale that is a least grayscale value greater than the grayscale of the received data and a second sample-grayscale that is a greatest grayscale value that is less than the grayscale of the received data.

In an exemplary embodiment, the data correction value may have more bits than the received data.

In an exemplary embodiment, the data correction value f(m, n) may be defined by the following Equation: $f(m, n)=a\times X_m+b\times Y_n$, wherein (m, n) is the pixel position, X_m is the column correction value of the pixel position, Y_n is the row correction value of the pixel position, and "a" and "b" are predetermined weights.

According to still another exemplary embodiment of the invention, there is provided a method of calculating a correction value. The method includes calculating a first average luminance level of a pixel column of a sample-grayscale image displayed on a display panel and a second average luminance level of a pixel row of the displayed sample-grayscale image, calculating a column correction value corresponding to the pixel column using a first reference luminance level and the first average luminance level, calculating a row correction value corresponding to the pixel row using a second reference luminance level and the second average luminance level, and storing the column correction value and the row correction value.

In an exemplary embodiment, calculating the column correction value and the row correction value, may include calculating a positive column correction value when the first average luminance level of the pixel column is less than the first reference luminance level, and a negative column correction value when the first average luminance level is greater than the first reference luminance level, and calculating a positive row correction value when the second average luminance level of the pixel column is less than the second reference luminance level, and a negative column correction value when the second average luminance level is greater than the second reference luminance level.

In an exemplary embodiment, a number of sample-grayscales may be less than a total number of grayscales of the image data.

According to still another exemplary embodiment of the invention, there is provided an apparatus for calculating a correction value includes a luminance profile calculating part configured to calculate a first average luminance level of a pixel column of a sample-grayscale image displayed on a display panel and a second average luminance level of a pixel row of the displayed sample-grayscale image, and a correction value calculating part configured to calculate a column correction value corresponding to the pixel column using a first reference luminance level and the first average luminance level, and a row correction value corresponding to the pixel row using a second reference luminance level and the second average luminance level.

In an exemplary embodiment, the correction value calculating part may calculate a positive column correction value when the first average luminance level of the pixel column is less than the first reference luminance level and a negative column correction value when the first average luminance level is greater than the first reference luminance level, and calculate a positive row correction value when the second average luminance level of the pixel column is less than the second reference luminance level and a negative column correction value when the second average luminance level is greater than the second reference luminance level.

In an exemplary embodiment, a number of sample-grayscales may be less than a total number of grayscales of image data.

In an exemplary embodiment, the apparatus may include a storage part configured to store the column correction value and the row correction value.

According to the present disclosure, a stain, such as a line type observed on the display panel, may be compensated. In particular, line stains such as a horizontal line type, a vertical line type, etc., that frequently occur in a large-sized display panel, may be compensated.

DETAILED DESCRIPTION OF EXEMPLARY EMBODIMENTS

Hereinafter, exemplary embodiments of the present disclosure will be explained in detail with reference to the accompanying drawings.

Figure 1:
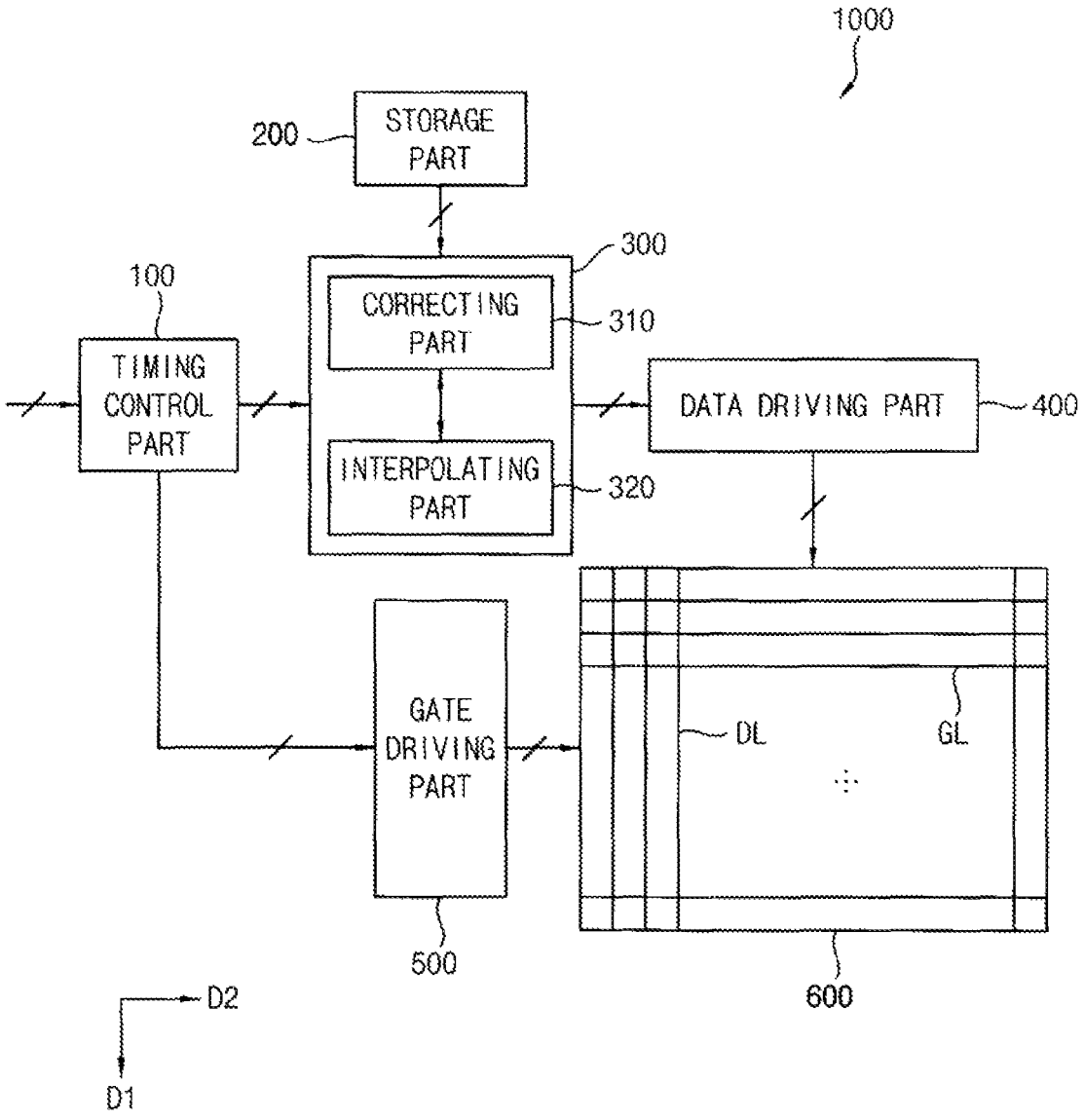
FIG. 1 is a block diagram illustrating a display apparatus according to an exemplary embodiment.

FIG. 1 is a block diagram illustrating a display apparatus according to an exemplary embodiment.

Referring to FIG. 1, a display apparatus 1000 may include a timing control part 100, a storage part 200, a stain correction part 300, a data driving part 400, a gate driving part 500 and a display panel 600.

The timing control part 100 receives image data ("data") and a synchronization signal. The timing control part 100 provides the stain correction part 300 with the data, and generates a timing control signal to control a driving timing of the display apparatus based on the synchronization signal. The timing control part 100 generally controls the display apparatus.

The storage part 200 stores M column correction values and N row correction values corresponding to each of K sample-grayscales. Herein, K may be a natural number less than the number of grayscales of the data, M may be the number of pixel columns arranged in a row direction D2 of the display panel 600 and N may be the number of pixel rows arranged in a column direction D1. For example, when the display panel 600 has a resolution of 1920×1080, M may be 1920 and N may be 1080. The storage part 200 may have a size of about [K×M+N]×[number of bits of the correction value]. In the display panel 600 that displays a grayscale image of a sample-grayscale, the column correction value is calculated based on an average luminance of pixels included in the pixel column and the row correction value is calculated based on an average luminance of pixels included in the pixel row. The column correction value and the row correction value will be further explained below.

The stain correction part 300 may include a correcting part 310 and an interpolating part 320. The stain correction part 300 generates correction data respectively corresponding to the data of whole pixels in the display panel 600 using correction values stored in the storage part 200.

When the grayscale of the received data is a sample-grayscale, the correcting part 310 calculates a data correction value by adding the column correction value and the row correction value corresponding to a pixel position of the received data. The correcting part 310 calculates correction data using the data correction value to compensate for the stain of the display panel 600.

When X and Y-coordinates of a pixel position are (m, n), the column correction value is X_m and the row correction value is Y_n, and the data correction value (f(m, n)) of the received data may be defined by the following Equation. Here, m may be 1≤m≤M, and n may be 1≤n≤N.

$$f(m,n)=a\times X_m+b\times Y_n \qquad \text{Equation}$$

Here, "a" is a weighted value with respect to the row direction, and "b" is a weighted value with respect to the column direction. The data correction value may have a greater number of bits than the data value.

When the grayscale of the received data is not a sample-grayscale, the interpolating part 320 calculates a data correction value between a first data correction value and a second data correction value provided from the correcting part 310 using a linear interpolation algorithm.

For example, when the grayscale of the received data is not a sample-grayscale, the correcting part 310 calculates the first data correction value using a first column correction value and a first row correction value corresponding to the pixel position from correction values of a first sample-grayscale. The first sample-grayscale is the largest grayscale value that is less than the sample-grayscale of the received data. In addition, the correcting part 310 calculates the second data correction value using a second column correction value and a second row correction value corresponding to the pixel position from correction values of a second sample-grayscale. The second sample-grayscale is the least grayscale value that is greater than the sample-grayscale of the received data. The correcting part 310 provides the interpolating part 320 with the first data correction value and the second data correction value.

The interpolating part 320 calculates the data correction value which corresponds to the grayscale and the pixel position of the received data, and which is interpolated between the first and second data correction values using linear interpolation. Thus, the correcting part 310 calculates the correction data using the data correction value received from the interpolating part 320.

The data driving part 400 converts the correction data received from the stain correction part 300 to a data voltage using a reference gamma voltage and provides the display panel 600 with the converted data voltage.

The gate driving part 500 generates a plurality of gate signals and sequentially provides the display panel 600 with the gate signals.

The display panel 600 may include a plurality of data lines DL, a plurality of gate lines GL and a plurality of pixels P. The data lines extend in a first direction ("column direction") D1, are electrically connected to output terminals of the data driving part 400 and receive the data voltages. The gate lines extend in a second direction ("row direction") D2 crossing the first direction D1, are electrically connected to output terminals of the gate driving part 500 and receive the gate signals. The pixels P are arranged as a matrix which includes a plurality of pixel columns and a plurality of pixel rows.

Figure 2A:
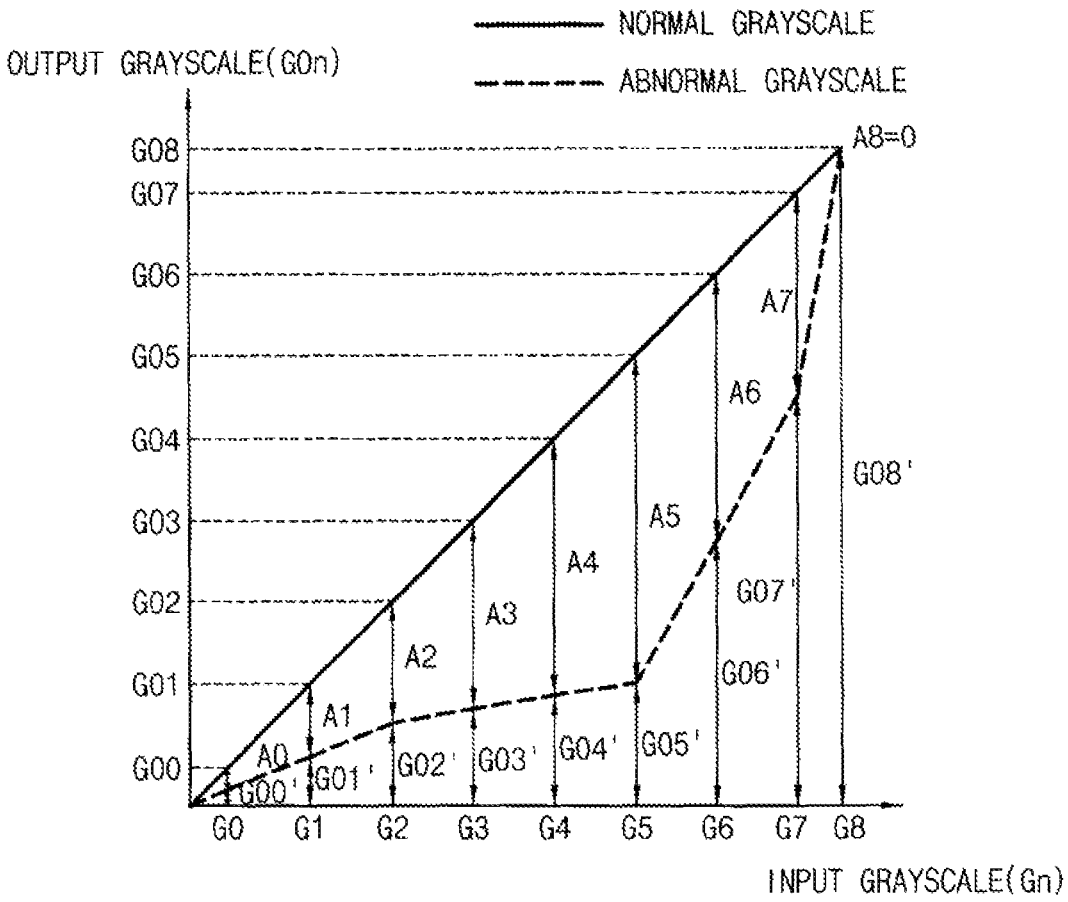
FIGS. 2A and 2B are conceptual diagrams illustrating a method of correcting according to the stain correcting part of the display apparatus shown in FIG. 1.
Figure 2B:
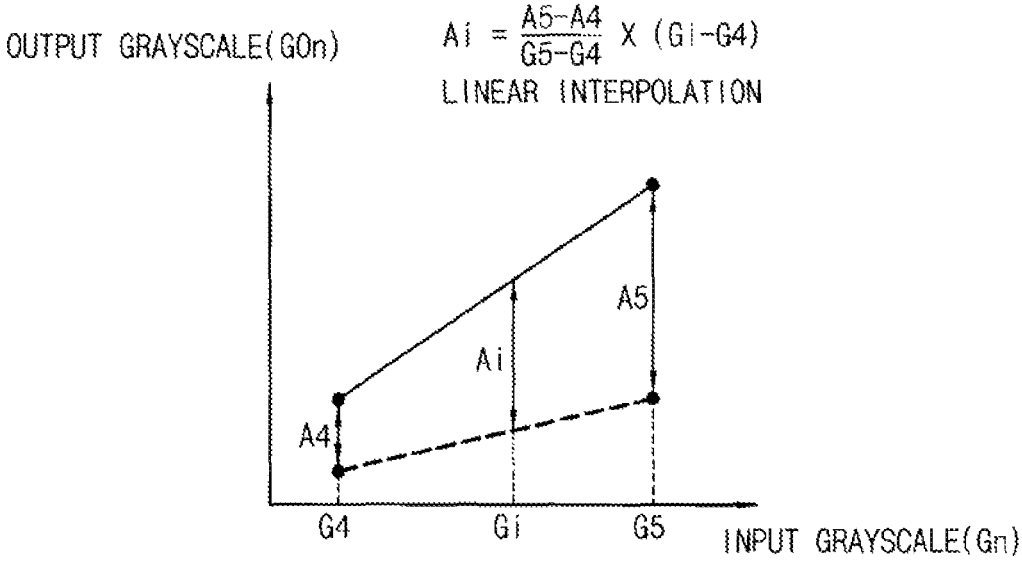

FIGS. 2A and 2B are conceptual diagrams illustrating a method of correcting according to the stain correcting part of the display apparatus shown in FIG. 1.

Referring to FIGS. 1 and 2A, Gn is an input grayscale of the data, in which n is a natural number, for example, n=1, 2, 3, . . . , 8. GOn is a normal output grayscale when the input grayscale Gn is displayed on a normal display panel without a stain. GOn' is an abnormal output grayscale when the input grayscale Gn is displayed on an abnormal display panel with a stain. "An" is the correction value to compensate for the abnormal output grayscale GOn' by converting it into the normal output grayscale GOn. In other words, when the correction value An and the input grayscale Gn is applied to the abnormal display panel, the abnormal display panel may display the normal output grayscale GOn.

For example, the storage part 200 stores correction values A0, A1, A2, . . . , A8 respectively corresponding to the input grayscales G0, G1, G2, . . . , G8. When a grayscale G1 of the received data is among the sample-grayscales G0, G1, G2, . . . , G8, the correcting part 310 adds the correction value A1 stored in the storage part 200 to the grayscale G1.

According to a present exemplary embodiment, when a received data grayscale G1 is a sample-grayscale, the correcting part 310 can use the Equation to calculate a data correction value using the column correction value and the row correction value corresponding to the pixel position of the received data from the correction values of the grayscale G1 stored in the storage part 200. The correcting part 310 adds the data correction vale to the data of the grayscale G1 to calculate the correction data. The pixel driven by the correction data may display the normal output grayscale GO1 corresponding to the grayscale G1.

Referring to FIGS. 1 and 2B, when a grayscale Gi of the received data is between the sample-grayscales G0, G1, G2, . . . , G8, for example, between the sample-grayscales G4 and G5, the correcting part 310 provides correction values A4 and A5 of the sample-grayscales G4 and G5 adjacent to the grayscale Gi, to the interpolating part 320. The interpolating part 320 can use the Equation to calculate the correction value Ai of the grayscale Gi interpolated from the correction values A4 and A5 of the grayscales G4 and G5 using linear interpolation. The correcting part 310 adds the correction value Ai to the grayscale Gi.

According to a present exemplary embodiment, the correcting part 310 can use the Equation to calculate the data correction value using the column correction value and the row correction value corresponding to the pixel position of the received data from the correction values of the sample-grayscale G4. The sample-grayscale G4 is the largest grayscale value that is less than the grayscale Gi of the received data. Then, the correcting part 310 calculates the data correction value using the column correction value and the row correction value corresponding to the pixel position of the received data from the correction values of the sample-grayscale G5. The sample-grayscale G5 is the least grayscale value that is greater than the grayscale Gi of the received data. The interpolating part 320 calculates the data correction value of the grayscale Gi between the data correction value of the sample-grayscale G4 and the data correction value of the sample-grayscale G5 using linear interpolation. The correcting part 310 adds the calculated correction value to the received data of the grayscale Gi to calculate the correction data. The pixel driven by the correction data may display an image of the normal output grayscale GOi corresponding to the grayscale Gi.

Figure 3:
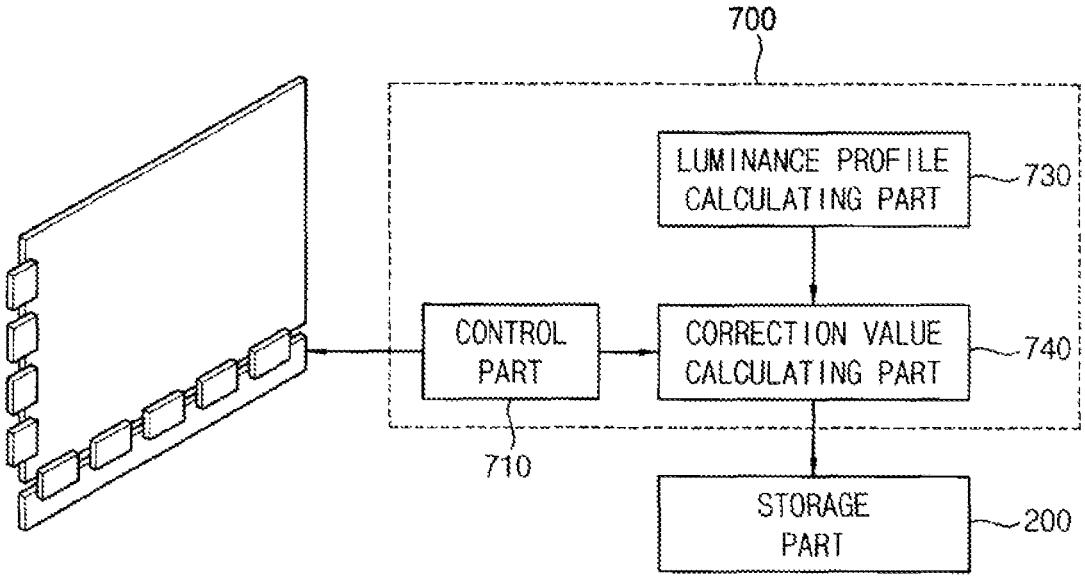
FIG. 3 is a block diagram illustrating an apparatus for calculating a correction value according to an exemplary embodiment.
Figure 4:
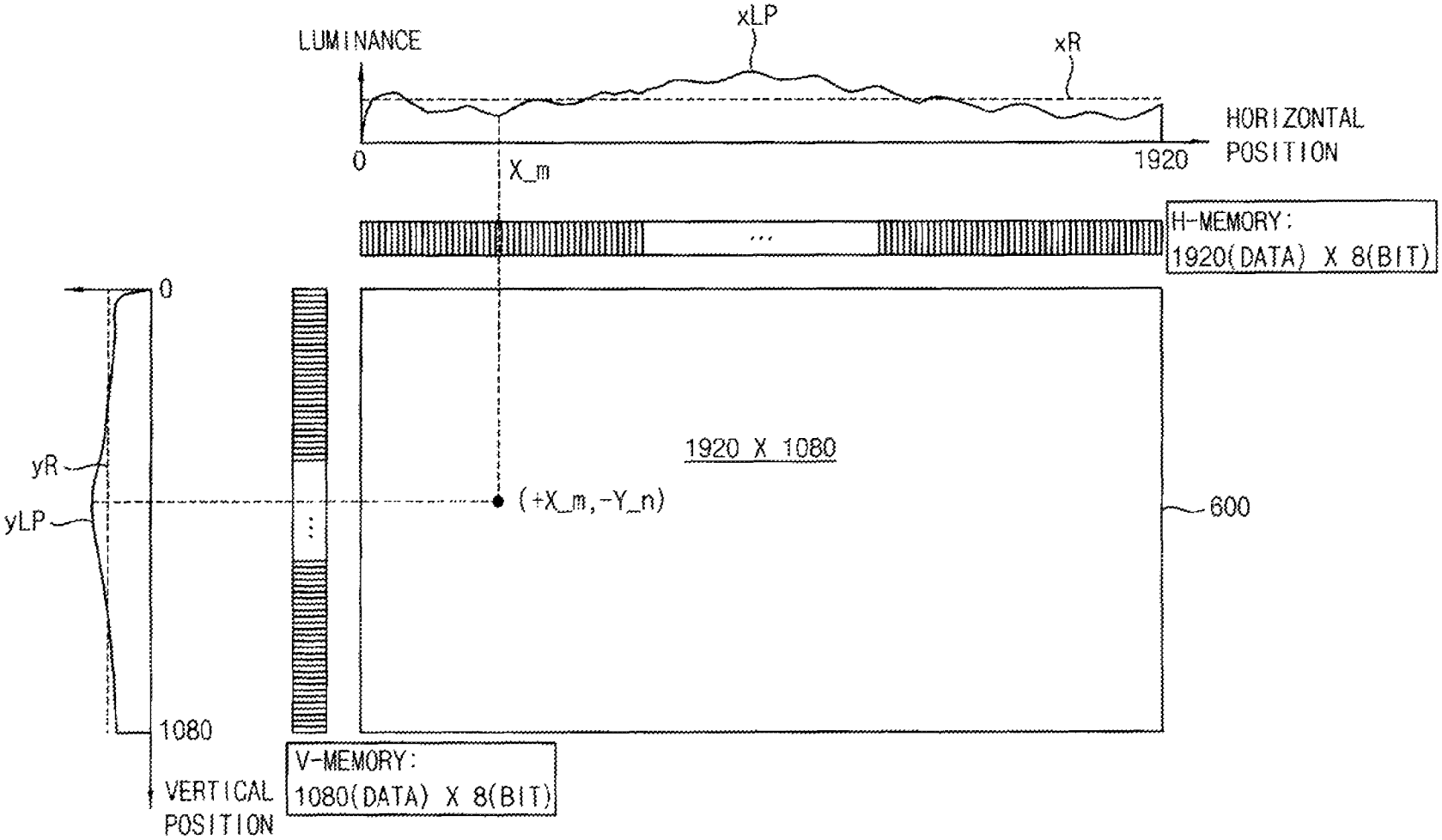
FIG. 4 is a conceptual diagram illustrating a method of calculating a correction value according to the apparatus shown in FIG. 3.
Figure 5:
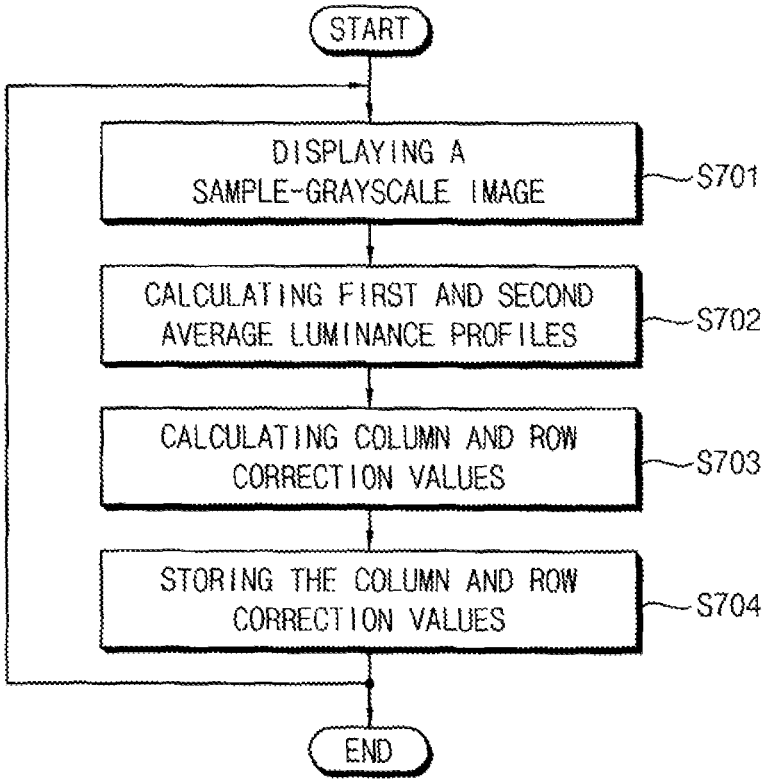
FIG. 5 is a flowchart view illustrating the method of calculating the correction value according to the apparatus shown in FIG. 3.

FIG. 3 is a block diagram illustrating an apparatus 700 for calculating a correction value according to an exemplary embodiment. FIG. 4 is a conceptual diagram illustrating a method of calculating a correction value according to the apparatus shown in FIG. 3. FIG. 5 is a flowchart view illustrating the method of calculating the correction value according to the apparatus shown in FIG. 3.

Referring to FIGS. 1, 3 and 4, the apparatus 700 may include a control part 710, a luminance profile calculating part 730 and a correction value calculating part 740.

Referring to FIGS. 3 and 5, the control part 710 displays a grayscale image of the sample-grayscale on the display apparatus 1000 (Step S701), and provides the grayscale image to the luminance profile calculating part 730. For example, suppose eight sample-grayscales for 8-bit data are predetermined as 16-grayscale, 24-grayscale, 32-grayscale, 64-grayscale, 86-grayscale, 128-grayscale, 192-grayscale and 244-grayscale. The display apparatus 1000 displays the grayscale image of one of the eight sample-grayscales.

The luminance profile calculating part 730 analyzes the grayscale image received from the control part 710 and calculates a first average luminance profile xLP in the row direction (X-axis direction) and a second average luminance profile yLP in the column direction (Y-axis direction) (Step S703). The first average luminance profile xLP is a profile corresponding to the average luminance level of the pixels in each pixel column of the display panel 600. The second average luminance profile xLP is a profile corresponding to the average luminance level of the pixels in each pixel row of the display panel 600.

The correction value calculating part 740 calculates the column correction value and the row correction value using the first average luminance profile xLP and the second average luminance profile xLP (Step S704). The correction value calculating part 740 calculates M column correction values corresponding to M pixel columns using the first average luminance profile xLP and a first reference luminance level xR. As shown in FIG. 4, the correction value calculating part 740 calculates 1920 column correction values for a 1920×1080 resolution display panel. For example, the correction value calculating part 740 compares an average luminance level of each of the first to M-th pixel columns with the first reference luminance level xR. When the average luminance level is less than the first reference luminance level xR, the correction value calculating part 740 determines the column correction value as a positive column correction value. When the average luminance level is greater than the first reference luminance level xR, the correction value calculating part 740 determines the column correction value as a negative column correction value. As shown in FIG. 4, the column correction value X_m corresponding to the pixel position (m, n) is a positive correction value +X_m because the average luminance level of an m-th pixel column is less than the first reference luminance level xR.

In addition, the correction value calculating part 740 calculates N row correction values corresponding to N pixel rows using the second average luminance profile yLP and a second reference luminance level yR. As shown in FIG. 4, the correction value calculating part 740 calculates 1080 row correction values for a 1920×1080 resolution display panel. For example, the correction value calculating part 740 compares an average luminance level of each of the first to N-th pixel rows with the second reference luminance level yR. When the average luminance level is less than the second reference luminance level yR, the correction value calculating part 740 determines the row correction value as a positive row correction value. When the average luminance level is more than the second reference luminance level yR, the correction value calculating part 740 determines the row correction value as a negative row correction value. As shown in FIG. 4, the row correction value Y_n corresponding to the pixel position (m, n) is a negative correction value −Y_n because the average luminance level of an n-th pixel row is greater than the second reference luminance level yR. Therefore, a stain, such as a horizontal line type and a vertical line type on the display panel 600, may be compensated by the column correction value and the row correction value.

The control part 710 stores the column correction value and the row correction value calculated from the correction value calculating part 740 in the storage part 200 (Step S705).

As described above, the apparatus 700 according to a present exemplary embodiment calculates the column correction values and the row correction values corresponding to each of the K sample-grayscales and stores the correction values in the storage part 200.

The storage part 200 storing the correction values is disposed in the display apparatus 1000. As described with reference to FIGS. 1 to 4, the received data are compensated using the correction values in the storage part 200 so that a stain may be improved.

Figure 6:
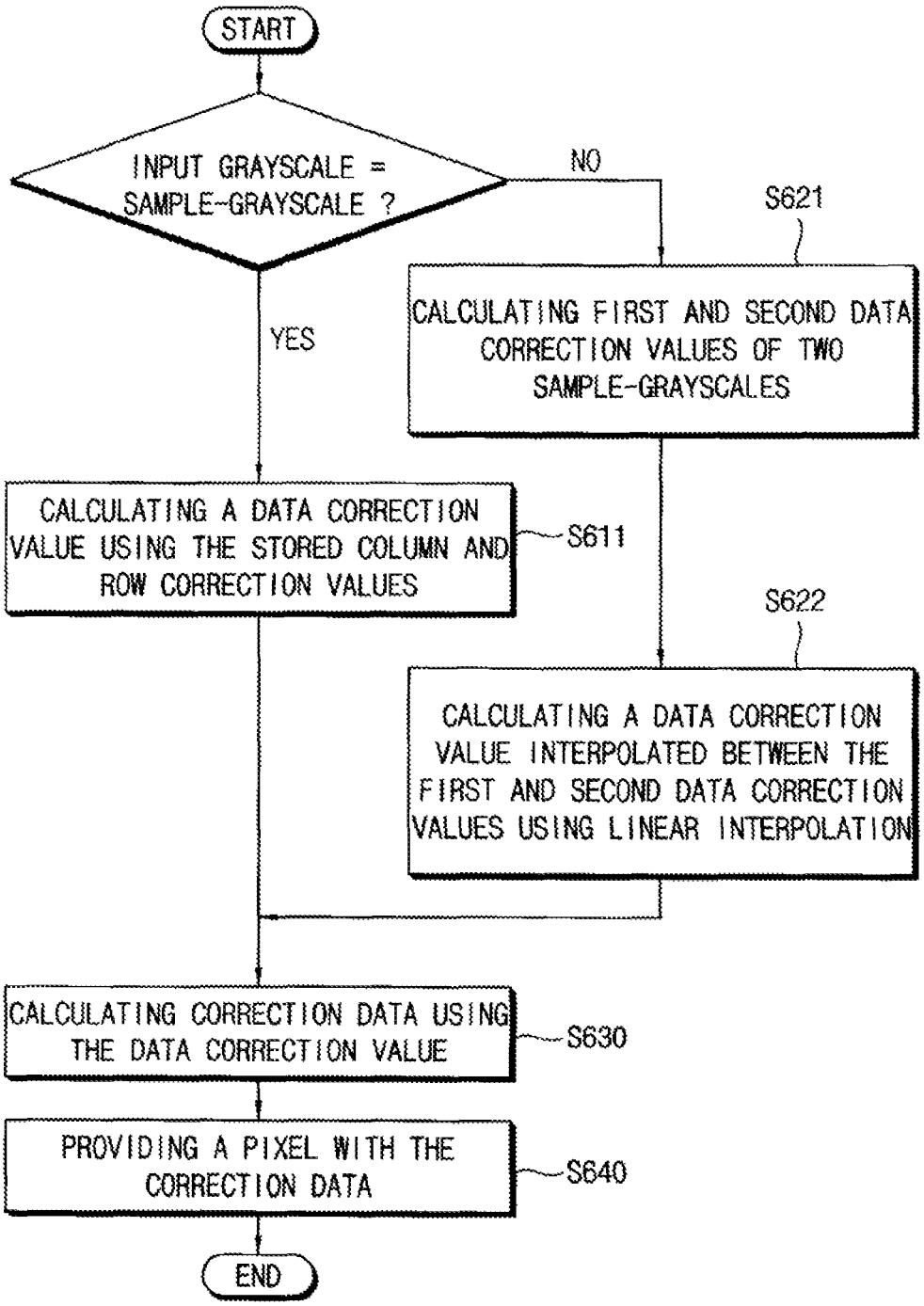
FIG. 6 is a flowchart view illustrating a method of displaying an image according to the display apparatus shown in FIG. 1.

FIG. 6 is a flowchart view illustrating a method of displaying an image according to the display apparatus shown in FIG. 1.

Referring to FIGS. 1 and 6, the timing control part 100 provides the stain correction part 300 with the received data based on a vertical synchronization signal and a horizontal synchronization signal.

The stain correction part 300 may include the correcting part 310 and the interpolating part 320, and generates correction data using the column correction value and the row correction value stored in the storage part 200 corresponding to the pixel position of the received data.

For example, when the grayscale of the received data is a sample-grayscale, the correcting part 310 calculates the data correction value using the column correction value and the row correction value corresponding to the pixel position of the received data (Step S611). The data correction value may be calculated by adding the column correction value and the row correction value, as expressed by the Equation. The data correction value may have a greater number of bits than the received data value.

The correcting part 310 adds the data correction value to the received data, to calculate the correction data (Step S630). The correction data are applied to the display panel 600 through the data driving part 400 (Step S640). The pixel driven by the correction data may display the image of a normal output grayscale corresponding to the grayscale of the received data.

For example, suppose the received data is 8-bit data corresponding to 16-grayscale and the sample-grayscales include 16-grayscale and 24-grayscale. Suppose further that a column correction value of "−1" and a row correction value of "+4" corresponding to the pixel position of the received data are stored in the storage part 200. Then, the correcting part 310 can use the Equation to calculate a data correction value of "3" using the column correction value "−1" and the row correction value "+4" stored in the storage part 200. Here, the weighted values "a" and "b" may have a default value of "1". The correcting part 310 adds the data correction value "3" to the received data of the 16-grayscale to calculate the correction data. In this case, when the data correction value is 12 bits longer than the 8-bit received data, the correction data may be "16+3/16" bits.

When the grayscale of the received data is not a sample-grayscale, the correcting part 310 calculates the first data correction value using the first column correction value and the first row correction value corresponding to the pixel position from the correction values of a least sample-grayscale that is greater than the grayscale of the received data. In addition, the correcting part 310 calculates the second data correction value using the second column correction value and the second row correction value corresponding to the pixel position from the correction values of a greatest sample-grayscale that is less than the grayscale of the received data (Step S621). The interpolating part 320 calculates the data correction value between the first and second data correction values using linear interpolation such that the data correction value corresponds to the grayscale and pixel position of the received data (Step S622).

The correcting part 310 applies the data correction value to the received data to calculate the correction data (Step S630). The correction data are provided to the display panel 600 through the data driving part 400 (Step S640). Therefore, the pixel driven by the correction data may display the image of a normal output grayscale corresponding to the grayscale of the received data.

For example, suppose the received data is 8-bit data corresponding to 20-grayscale and the sample-grayscale includes 16-grayscale and 24-grayscale. Suppose further that a column correction value of "−1" and a row correction value of "+4" correspond to the pixel position from the correction values of a first sample-grayscale. Then, the correcting part 310 can use the Equation to calculate a first data correction value of "+3" using the column correction value of "−1" and the row correction value of "+4" corresponding to the pixel position. Here, the first sample-grayscale is the 24-grayscale, which the least grayscale that is greater than the 20-grayscale of the received data.

Now, suppose that a column correction value of "+3" and a row correction value of "+4" correspond to the pixel position from the correction values of a second sample-grayscale. The correcting part 310 can use the equation to calculate a second data correction value of "+7" using the column correction value of "+3" and the row correction value of "+4" from the correction values of a second sample-grayscale. Here, the second sample grayscale is the 16-grayscale, which is the greatest grayscale that is less than the 20-grayscale of the received data. The interpolating part 320 calculates the data correction value "+5" corresponding to the 20-grayscale between the first data correction value of "+3" of the 24-grayscale and the second data correction value of "+7" of the 16-grayscale using linear interpolation. The correcting part 310 adds the data correction value of "+5" to the received data to calculate the correction data. In this case, when the data correction value is 12 bits longer than the 8-bit received data, the correction data may be "20+5/16" bits.

According to exemplary embodiments of the present disclosure, a stain, such as a line type on the display panel, may be compensated. In particular, a line stain, such as a horizontal line type, a vertical line type, etc., that frequently occur in large-sized display panels may be compensated. In addition, compensation errors resulting from using human testers may be prevented.

The foregoing is illustrative of embodiments of the present disclosure and is not to be construed as limiting thereof. Although a few exemplary embodiments of the present disclosure have been described, those skilled in the art will readily appreciate that many modifications are possible in the exemplary embodiments without materially departing from the novel teachings of the present disclosure. Accordingly, all such modifications are intended to be included within the scope of the present invention as defined in the claims. Therefore, it is to be understood that the foregoing is illustrative of the present disclosure and is not to be construed as limited to the specific exemplary embodiments disclosed, and that modifications to the disclosed exemplary embodiments, as well as other exemplary embodiments, are intended to be included within the scope of the appended claims, with equivalents of the claims to be included therein.

What is claimed is:

1. A computer-implemented method of displaying an image on a display panel having a plurality of pixels arranged in rows and columns, the method, performed by a computer, comprising the steps of:

calculating a row correction value corresponding to a pixel position of a received data based on an average luminance of pixels in a pixel row of a sample-grayscale image;

calculating a column correction value corresponding to the pixel position of the received data based on an average luminance of pixels in a pixel column of the sample-grayscale image;

generating correction data for the received data using the row correction value and the column correction value corresponding to the pixel position of the received data; and converting the correction data to a data voltage to provide a data line of the display panel with the data voltage, wherein the correction data is a value f(m, n) defined by Equation: $f(m, n)=a\times X_m+b\times Y_n$ wherein (m, n) is the pixel position, X_m is the column correction value of the pixel position, Y_n is the row correction value of the pixel position, and "a" and "b" are predetermined weights.

2. The method of claim 1, wherein generating the correction data comprises:

determining whether a grayscale of the received data corresponds to a sample-grayscale.

3. The method of claim 2, wherein when the grayscale of the received data is a sample-grayscale, the method further comprises:

adding the row correction value and the column correction value of the sample-grayscale corresponding to the pixel position of the received data to calculate a data correction value; and applying the data correction value to the received data to generate the correction data.

4. The method of claim 2, wherein when the grayscale of the received data is not a sample-grayscale, the method further comprises:

adding a row correction value and a column correction value of a first sample-grayscale corresponding to the pixel position of the received data to calculate a first data correction value, the first sample-grayscale being a least grayscale value that is greater than the grayscale of the received data;

adding a row correction value and a column correction value of a second sample-grayscale corresponding to the pixel position of the received data to calculate a second data correction value, the second sample-grayscale being a greatest grayscale value that is less than the grayscale of the received data; and applying the first data correction value and the second data correction value to the received data to generate the correction data.

5. The method of claim 1, wherein the data correction values have more bits than the received data.

6. A display apparatus comprising:

a display panel having a plurality of pixels arranged in rows and columns;

a storage part configured to store a row correction value and a column correction value corresponding to a sample-grayscale, wherein the row correction value is calculated based on an average luminance of pixels in a pixel row of a sample-grayscale image and 3 the column correction value is calculated based on an average luminance of pixels in a pixel column of the sample-grayscale image;

a stain correction part configured to generate correction data for received data using a row correction value and a column correction value corresponding to a pixel position of the received data; and a data driving part configured to convert the correction data to a data voltage to provide a data line of the display panel with the data voltage, wherein the correction data is a value f(m, n) defined by Equation: $f(m, n)=a\times X_m+b\times Y_n$ wherein (m, n) is the pixel position, X_m is the column correction value of the pixel position, Y_n is the row correction value of the pixel position, and "a" and "b" are predetermined weights.

7. The display apparatus of claim 6, wherein the stain correction part comprises:

a correcting part configured to add the row correction value and the column correction value to calculate a data correction value and to apply the data correction value to the received data to generate the correction data; and an interpolating part configured to calculate the data correction value using linear interpolation.

8. The display apparatus of claim 7, wherein when the grayscale of the received data is a sample-grayscale, the correcting part adds the row correction value and the column correction value of the sample-grayscale corresponding to the pixel position of the received data to calculate a data correction value, and applies the data correction value to the received data to generate the correction data.

9. The display apparatus of claim 7, wherein when the grayscale of the received data is not a sample-grayscale, the correcting part calculates a first data correction value and a second data correction value using a row correction value and a column correction values of two sample-grayscales, and the interpolating part calculates the data correction value corresponding to the grayscale of the received data using linear interpolation.

10. The display apparatus of claim 9, wherein the two sample-grayscales include a first sample-grayscale that is a least grayscale greater than the grayscale of the received data and a second sample-grayscale that is a greatest grayscale less than the grayscale of the received data.

11. The display apparatus of claim 6, wherein the data correction value has more bits than the received data.

12. A computer-implemented method of calculating a correction value, the method, performed by a computer, comprising the steps of:

calculating a first average luminance level of a pixel column of a sample-grayscale image displayed on a display panel and a second average luminance level of a pixel row of the displayed sample-grayscale image;

calculating a column correction value corresponding to the pixel column using a first reference luminance level and the first average luminance level;

calculating a row correction value corresponding to the pixel row using a second reference luminance level and the second average luminance level; and storing the column correction value and the row correction value, wherein calculating the column correction value and the row correction value comprises:

calculating a positive column correction value when the first average luminance level of the pixel column is less than the first reference luminance level, and a negative column correction value when the first average luminance level is greater than the first reference luminance level; and calculating a positive row correction value when the second average luminance level of the pixel column is less than the second reference luminance level, and a negative column correction value when the second average luminance level is greater than the second reference luminance level.

13. The display apparatus of claim 12, wherein a number of sample-grayscales is less than a total number of grayscales of the image data.

14. An apparatus for calculating a correction value comprising:

a luminance profile calculating part configured to calculate a first average luminance level of a pixel column of a sample-grayscale image displayed on a display panel and a second average luminance level of a pixel row of the displayed sample-grayscale image; and a correction value calculating part configured to calculate a column correction value corresponding to the pixel column using a first reference luminance level and the first average luminance level, and a row correction value corresponding to the pixel row using a second reference luminance level and the second average luminance level, wherein the correction value calculating part calculates a positive column correction value when the first average luminance level of the pixel column is less than the first reference luminance level and a negative column correction value when the first average luminance level is greater than the first reference luminance level, and calculates a positive row correction value when the second average luminance level of the pixel column is less than the second reference luminance level and a negative column correction value when the second average luminance level is greater than the second reference luminance level.

15. The apparatus of claim 14, wherein a number of sample-grayscales is less than a total number grayscales of image data.

16. The apparatus of claim 14, further comprising a storage part configured to store the column correction value and the row correction value.

* * * * *